US008499700B2

(12) United States Patent
Schumacher

(10) Patent No.: US 8,499,700 B2
(45) Date of Patent: Aug. 6, 2013

(54) BRACE ATTACHMENT FOR PALLETS

(76) Inventor: Barry Schumacher, St. Augustine, FL (US)

( * ) Notice: Subject to any disclaimer, the term of this patent is extended or adjusted under 35 U.S.C. 154(b) by 0 days.

(21) Appl. No.: 13/325,651

(22) Filed: Dec. 14, 2011

(65) Prior Publication Data

US 2012/0145049 A1 Jun. 14, 2012

Related U.S. Application Data

(60) Provisional application No. 61/459,537, filed on Dec. 14, 2010.

(51) Int. Cl.
*B65D 19/44* (2006.01)

(52) U.S. Cl.
USPC ..... 108/55.1

(58) Field of Classification Search
USPC ..... 108/51.11, 55.1, 55.3, 55.5, 56.1; 248/346.02; 206/386, 598, 599, 597, 596, 206/595, 600
See application file for complete search history.

(56) References Cited

U.S. PATENT DOCUMENTS

| | | | | | |
|---|---|---|---|---|---|
| 564,740 | A * | 7/1896 | Dietz | 108/55.1 |
| 3,168,060 | A * | 2/1965 | Farley | 108/53.5 |
| 3,277,848 | A * | 10/1966 | Runge et al. | 108/55.1 |
| 3,289,613 | A * | 12/1966 | Evans | 108/53.5 |
| 3,438,343 | A * | 4/1969 | McConnell | 108/53.5 |
| 3,832,956 | A * | 9/1974 | Briel, Jr. | 108/55.1 |
| 4,068,599 | A * | 1/1978 | Sapp et al. | 108/55.1 |
| 4,292,901 | A * | 10/1981 | Cox | 108/55.1 |
| 4,638,744 | A * | 1/1987 | Clive-Smith | 108/56.1 |
| 5,439,152 | A * | 8/1995 | Campbell | 108/55.1 |
| 5,639,174 | A * | 6/1997 | Gonska | 108/55.1 |
| 6,298,999 | B1 * | 10/2001 | Bellman | 108/55.1 |
| 6,783,012 | B2 * | 8/2004 | Webb | 108/55.1 |

* cited by examiner

*Primary Examiner* — Jose V Chen
(74) *Attorney, Agent, or Firm* — Thomas C. Saitta

(57) ABSTRACT

A brace attachment device for wooden pallets having a pair of assemblies attachable to opposing sides of a pallet, each assembly having a pair of legs connected by a cross-brace and a mounting bracket associated with each leg. The mounting brackets are structured such that the legs can be repositioned between a generally horizontal and flat storage position substantially parallel with the top of the pallet, and a vertical support position to maintain objects or boxes upright on the pallet.

12 Claims, 3 Drawing Sheets

BRACE ATTACHMENT FOR PALLETS

This application claims the benefit of U.S. Provisional Patent Application Ser. No. 61/459,537, filed Dec. 14, 2010, the disclosure of which is incorporated herein by reference.

BACKGROUND OF THE INVENTION

This invention relates generally to the field of pallets used for movement, transport and storage of goods, and more particularly relates to braces, racks or frame attachments adapted for attachment to wooden pallets to improve retention of odd-shaped goods that are stacked edgewise, such as picture frames or mirrors.

Rectangular goods that are thin in cross-section, such as mirrors or picture frames, are shipped and stored on pallets with the objects and boxes aligned side-by-side and upright, i.e., with the thin sides of the objects or boxes positioned on the bottom and top. Plastic wrap, straps or similar means are stretched around the perimeter to hold the objects or boxes in place. Once the pallets arrive at the final destination where the individual objects or boxes are to be removed, the wrap or straps are cut. Because the pallet only supports the boxes from below, there is a tendency for the boxes to tilt to one side or the other after the wraps or straps have been removed, which often results in damage to the goods. Furthermore, it is very common to store the objects or boxes on the pallet after the wrap or strap has been removed such that individual objects or boxes can be removed as needed. To protect the objects from damage, it is common to attempt to maintain the objects or boxes in an upright orientation by leaning them inwardly from both sides after one or more have been removed, or by placing some sort of heavy object next to the pallet.

It is an object of this invention to provide a brace attachment device adapted to be mounted onto a wooden pallet, the brace attachment preventing the stacked boxes from excessive tilting once the wrap or straps have been removed. It is a further object to provide such a device which folds into a low profile atop the pallet such that storage or transport of empty pallets is more easily accomplished.

SUMMARY OF THE INVENTION

The invention is a brace attachment device for wooden pallets, the brace attachment device comprising a pair of assemblies attachable to opposing sides of a pallet. Each assembly comprises a pair of legs connected by a cross-brace and a mounting bracket associated with each leg. The mounting brackets are structured such that the legs can be repositioned between a generally horizontal and flat storage position substantially parallel with the top of the pallet, and a vertical support position, the horizontal orientation being useful during storage or transport of empty pallets, while the vertical orientation is the operational orientation to retain the boxes. The mounting brackets are provided with a pair of vertical slots and the legs are connected to the mounting brackets by a bolt running through the slots, thereby allowing the legs to be folded by first raising them relative to the slot and then pivoting them to the horizontal position, the lower portion of the slot being adjacent a retention member which maintains the legs in the vertical orientation by preventing any pivoting when the leg members are fully received in the brace members.

The brace attachment device may further comprise an extension assembly comprising a pair of extension legs and an extension cross-brace, the extension legs being retained telescopically within the legs of the main assembly. Locking means are provided to maintain the extension assembly in the extended position. Traversing cables extending between the two assemblies may also be provided to define a framework on all four sides of the pallet.

DETAILED DESCRIPTION OF THE INVENTION

Figure 1:
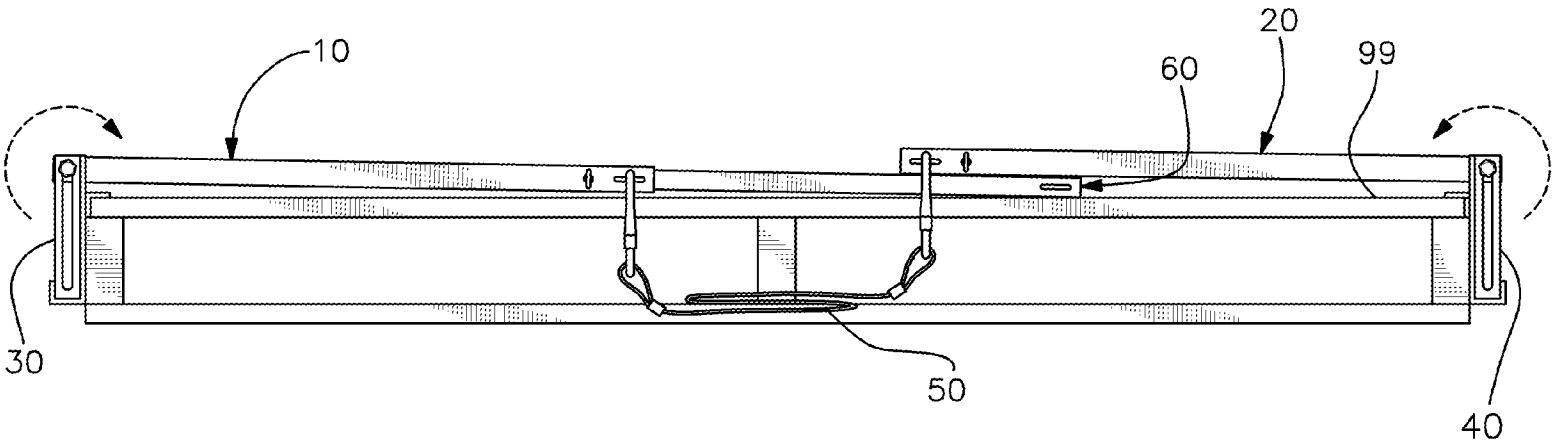
FIG. 1 shows an embodiment of the invention with the brace attachment devices mounted on a pallet in the nonuse or folded orientation, the embodiment also showing the extension assemblies and the cable members.

With reference to the drawings, the invention will be described in detail with regard for the best mode and preferred embodiments. In general the invention is a brace attachment device for wooden pallets, the brace attachment device comprising a pair of assemblies attachable to opposing sides of a pallet. Each assembly comprises a pair of legs connected by a cross-brace and a mounting bracket associated with each leg. The mounting brackets are structured such that the legs can be repositioned in either a horizontal position or a vertical position, the horizontal orientation being useful during storage or transport of empty pallets, while the vertical orientation is the operational position to retain objects or boxes positioned on the pallet in upright orientation. The mounting brackets are provided with a pair of vertical slots and the legs are connected to the mounting brackets by a bolt running through the slots.

The brace attachment device may further comprise an extension assembly comprising a pair of extension legs and an extension cross-brace, the extension legs being retained telescopically within the legs of the main assembly. Locking means are provided to maintain the extension assembly in the extended position. Traversing cables extending between the two assemblies may also be provided to provide a framework on all four sides.

As shown in the figures, the brace attachment device comprises a first assembly 10 and a second assembly 20, the assemblies 10 and 20 being mounted on opposing sides of a pallet 99. First assembly 10 comprises a pair of leg members 11 joined at or near their upper ends 14 by a cross-brace member 12, the cross-brace member 12 being attached to the leg members 11 by welding, mechanical fasteners or the like. The leg members 11 and cross-brace member 12 are preferably composed of tubular metal that is square in cross-section, although other materials of composition and other shapes will prove suitable. The lower end 15 of each leg member 11 is connected to a mounting bracket 30 in a manner that allows for limited relative movement between the mounting bracket 30 and the leg member 11, such that the leg member 11 can be oriented either vertically or horizontally.

Second assembly 20 is identical or at least similar in structure and composition to first assembly 10, and is comprised of leg members 21, cross-brace member 22 and mounting brackets 40.

Figure 3:
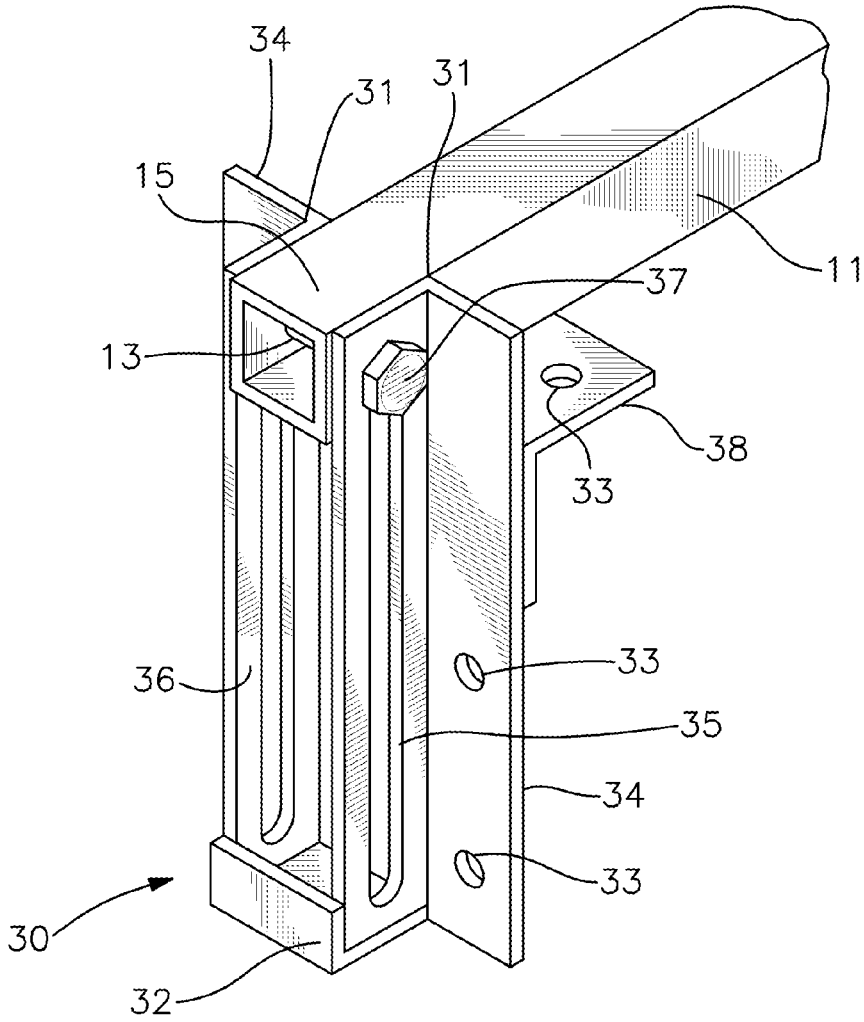
FIG. 3 is a view of a mounting bracket and leg, the leg being shown in the horizontal folded position relative to the mounting bracket.

As shown in FIG. 3, mounting bracket 30 comprises a pair of L-shaped flanges 31 joined at the bottom by a retention member 32, which may comprise a plate, flange or bar member, or any other similar structure suitable for retention of the lower end of the leg member 11. The L-shaped flanges 31 extend vertically and are spaced apart a distance only slightly larger than the width of leg member 11. One or more screw-receiving apertures 33 are disposed on the pallet abutment portion 34 of the L-shaped flanges 31, the apertures 33 being adapted to receive screws for attachment of the mounting bracket 30 to the side of a wooden pallet 99. A vertical slot 35 is disposed in the leg-receiving portion 36 of each L-shaped flange 31, the leg receiving portions 36 together defining a channel into which leg member 11 may be positioned. One or more additional upper attachment flanges 38 with screw-receiving apertures 33 may be provided for attachment of the mounting bracket 30 to the upper surface of the pallet 99.

Figure 2:
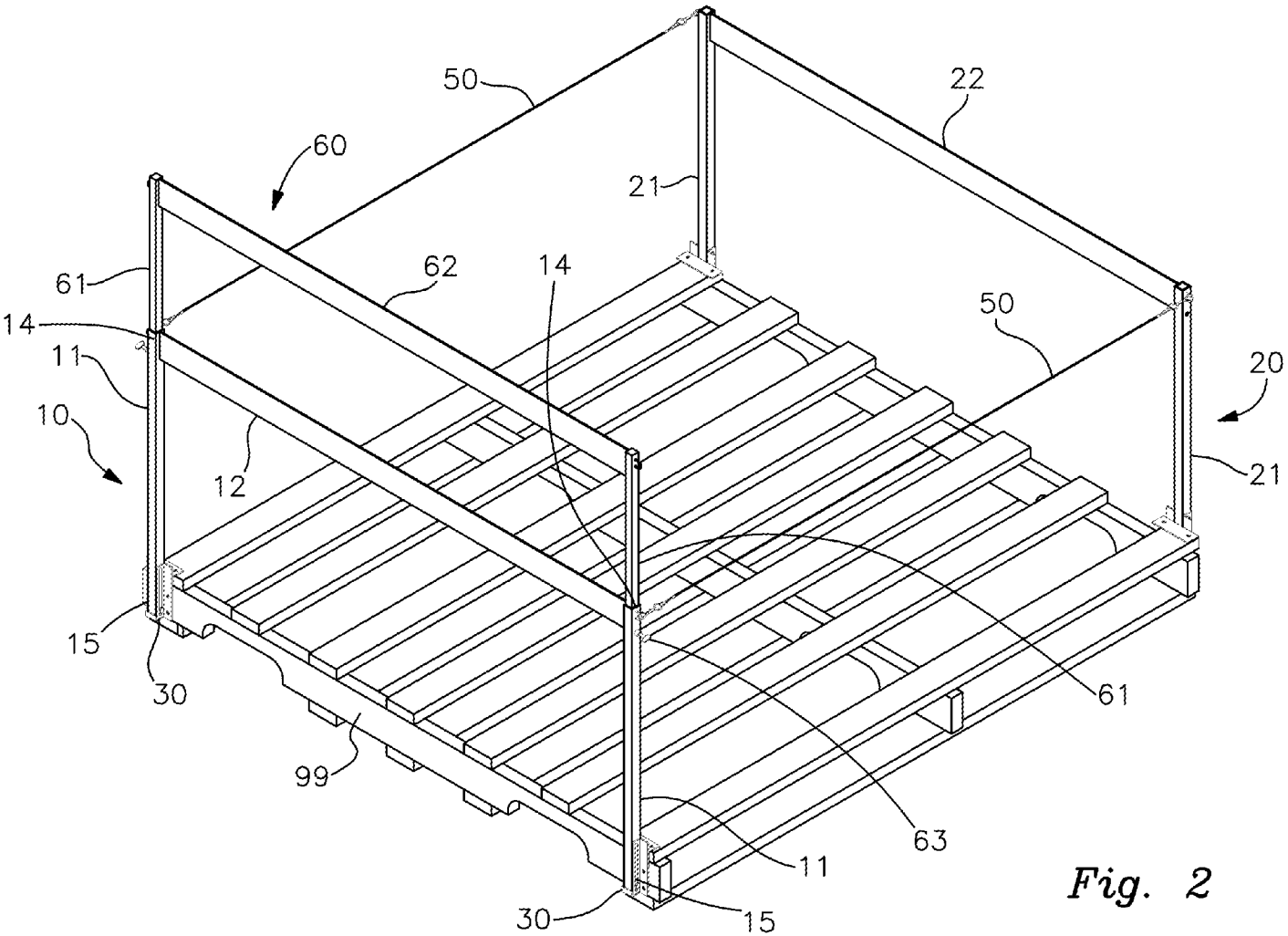
FIG. 2 shows the brace attachment devices mounted on a pallet in the use or upright orientation.

Leg member 11 is provided with bolt-receiving apertures 13 near its lower end 15, whereby a rod, bolt or similar structural member 37 may be inserted and fastened through the opposing slots 35 and bolt-receiving apertures 13, thereby securing the leg members 11 to the mounting brackets 30 in a manner that allows the leg members 11 to be lifted vertically from the mounting brackets 30 and tipped into the horizontal position, as shown in FIGS. 1 and 2. Likewise, the leg members 11 can be pivoted from the horizontal position back to the vertical position and pushed downward, such that the bolts 37 moves from the upper portion of slots 35 to the lower portion. Retention members 32 extends across the channel between the lower portions of the leg-receiving portions 36 of the mounting brackets 30, thereby preventing outward pivotal movement of the lower ends 15 of leg members 11 and thus maintaining the leg members 11 in the upright orientation until the leg members 11 are lifted vertically in the slots 35 such that the lower ends 15 clear the retention members 32.

Mounting brackets 40 for the second assembly 20 are identically or at least similarly constructed to mounting brackets 30 and perform in the same manner as described immediately above.

The brace attachment device may further comprise traversing cables 50 or similar elongated members extending between the leg members 11 of the first assembly 10 and the leg members 21 of the second assembly. Preferably, the cables 50 are releasable for easier removal of the boxes from the pallet. With this structure, restraint or support is provided on all four sides of the pallet 99.

In another alternative embodiment, the brace attachment device may further comprise one or two extension assemblies 60, the extension assembly 60 comprising a pair of extension leg members 61 joined by a cross-brace member 62. In this embodiment, the leg members 11 and 21 are provided with openings in their upper ends 14 such that the extension leg members 61 are telescopically received by the leg members 11 and 21. Alternatively, brackets or similar members could be mounted externally on leg members 11 and 21 to receive the extension assemblies 60. Mechanical members 63 adapted to lock the extension assembly 60 in the extended position, such as a setscrew disposed on leg members 11 and 21, are provided.

With the assemblies 10 and 20 in the upright orientation, edge-stacked objects or boxes on the pallet 99 are precluded from excessive tilting. Individual objects or boxes are easily removed through either open end of the pallet 99. When the pallet 99 is empty, the assemblies 10 and 20 may be folded into the compact orientation such that multiple pallets are readily stacked.

It is contemplated that equivalents and substitutions to certain elements set forth above may be obvious to those of ordinary skill in the art, and therefore the true scope and definition of the invention is to be as set forth in the following claims. The above description and drawings are meant to be illustrative rather than limiting.

I claim:

1. A brace attachment device adapted for attachment to a pallet, the device comprising:

a first and second assembly, each said assembly comprising a pair of leg members each having an upper end and a lower end, a mounting bracket connected to said lower end of each of said leg members, and a cross brace member connecting to said leg members to each other at or near said upper ends;

each said mounting bracket comprising a pair of L-shaped flanges connected together by a retention member, each said L-shaped flange comprising an abutment portion adapted to abut and be affixed to a pallet and a leg-receiving portion adapted to abut said lower end of said leg member, said leg-receiving portions positioned facing each other on opposing sides of said leg member, screw-receiving apertures disposed in said abutment portions and vertical slots disposed in said leg-receiving portions, wherein said retention member is connected to each of said leg-receiving portions of said L-shaped flanges such that with said leg member in a vertical position said lower end of said leg member abuts said leg-receiving portions and said retention member; and a bolt member extending through said slots of said mounting brackets and through the lower ends of said leg members;

whereby with said lower ends of said leg members raised such that said bolt members reside in the upper portions of said slots, said leg members can be pivoted into a horizontal position, and whereby with said leg members in a vertical position said bolt members reside in the lower portions of said slots and said retention members prevent pivoting of said leg members into said horizontal position.

2. The device of claim 1, each of said mounting brackets further comprising an upper attachment flange adapted to abut and be affixed to the pallet, wherein said upper abutment flange is connected to said abutment portions of said L-shaped flanges, said upper attachment flange comprising a screw-receiving aperture.

3. The device of claim 2, further comprising extension assemblies connected to said first and second assemblies, said extension assemblies comprising a pair of leg members connected by an extension cross-brace member.

4. The device of claim 2, further comprising a pallet, wherein said mounting brackets are connected to said pallet such that said first and second assemblies are positioned on opposite sides of said pallet, and wherein said first and second assemblies extend across said pallet when in the horizontal position and extend vertically from said pallet when in the vertical position.

5. The device of claim 1, further comprising a pair of cable members, said cable members extending between said first assembly leg members and said second assembly leg members.

6. The device of claim 5, where said cable members are releasably connected to said leg members.

7. The device of claim 5, further comprising extension assemblies connected to said first and second assemblies, said extension assemblies comprising a pair of leg members connected by an extension cross-brace member.

8. The device of claim 5, further comprising a pallet, wherein said mounting brackets are connected to said pallet such that said first and second assemblies are positioned on opposite sides of said pallet, and wherein said first and second assemblies extend across said pallet when in the horizontal position and extend vertically from said pallet when in the vertical position.

9. The device of claim 1, further comprising extension assemblies connected to said first and second assemblies, said extension assemblies comprising a pair of leg members connected by an extension cross-brace member.

10. The device of claim 9, wherein said extension assemblies are telescopically connected to said first and second assemblies.

11. The device of claim 9, further comprising a pallet, wherein said mounting brackets are connected to said pallet such that said first and second assemblies are positioned on opposite sides of said pallet, and wherein said first and second assemblies extend across said pallet when in the horizontal position and extend vertically from said pallet when in the vertical position.

12. The device of claim 1, further comprising a pallet, wherein said mounting brackets are connected to said pallet such that said first and second assemblies are positioned on opposite sides of said pallet, and wherein said first and second assemblies extend across said pallet when in the horizontal position and extend vertically from said pallet when in the vertical position.

* * * * *